United States Patent [19]

Keller

[11] Patent Number: 4,973,441

[45] Date of Patent: Nov. 27, 1990

[54] METHOD OF MANUFACTURING A COMPRESSIBILITY GRADIENT IN PAPER

[75] Inventor: Samuel F. Keller, Beloit, Wis.

[73] Assignee: Beloit Corporation, Beloit, Wis.

[21] Appl. No.: 385,622

[22] Filed: Jul. 26, 1989

[51] Int. Cl.[5] ..... B29C 43/24

[52] U.S. Cl. ..... 264/280; 162/205; 162/361; 264/175; 264/324; 264/343; 427/211; 427/361

[58] Field of Search ..... 264/175, 280, 324, 129, 264/134; 425/363; 162/205, 361; 264/343; 427/211, 361

[56] References Cited

U.S. PATENT DOCUMENTS

| | | | |
|---|---|---|---|
| 3,120,449 | 2/1964 | Griswold | 264/175 |
| 3,261,899 | 7/1966 | Coates | 264/175 |
| 4,378,639 | 4/1983 | Walker | 162/207 |
| 4,534,829 | 8/1985 | Ahrweiler et al. | 162/361 |
| 4,596,632 | 6/1986 | Goetz et al. | 162/136 |
| 4,670,102 | 6/1987 | Maurer et al. | 162/360.1 |
| 4,836,894 | 6/1989 | Chance et al. | 162/206 |

FOREIGN PATENT DOCUMENTS

| | | | |
|---|---|---|---|
| 0174661 | 3/1986 | European Pat. Off. | 162/205 |
| 2343930 | 3/1975 | Fed. Rep. of Germany | 264/175 |
| 737060 | 12/1932 | France | 264/175 |
| 5427033 | 9/1979 | Japan | 264/175 |

*Primary Examiner*—Jeffery Thurlow

*Attorney, Agent, or Firm*—Dirk J. Veneman; Raymond W. Campbell; David J. Archer

[57] ABSTRACT

The method includes the steps of coating the peripheral surface of a roll with a film of plasticizer. An offset roll disposed adjacent to the roll is rotated such that the roll and the offset roll define therebetween a transfer nip so that a film of the plasticizer is transferred to the offset roll. The web is moved past the offset roll such that the web contacts the offset roll downstream relative to the transfer nip so that the film of the plasticizer is offset onto the web. The web is then passed with the offset coating of plasticizer through a calendering nip such that between the offset coating of the web and the subsequent calendering of the web with the offset coating, the plasticizer is permitted to uniformly and controllably penetrate into the web such that the Z-directional compressibility of the web is controlled prior to the web extending through the calendering nip.

12 Claims, 2 Drawing Sheets

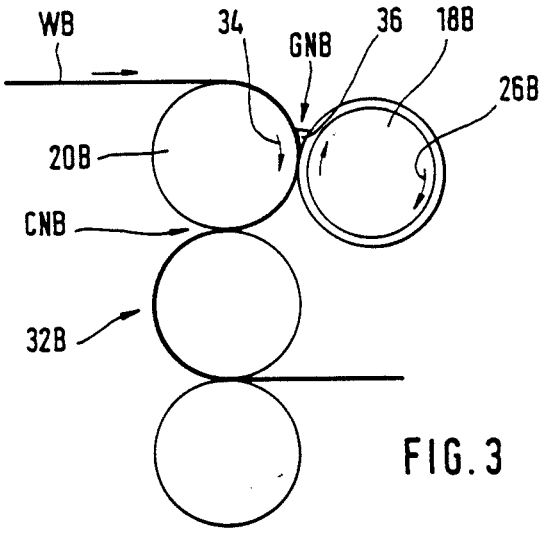
FIG. 3
FIG. 4
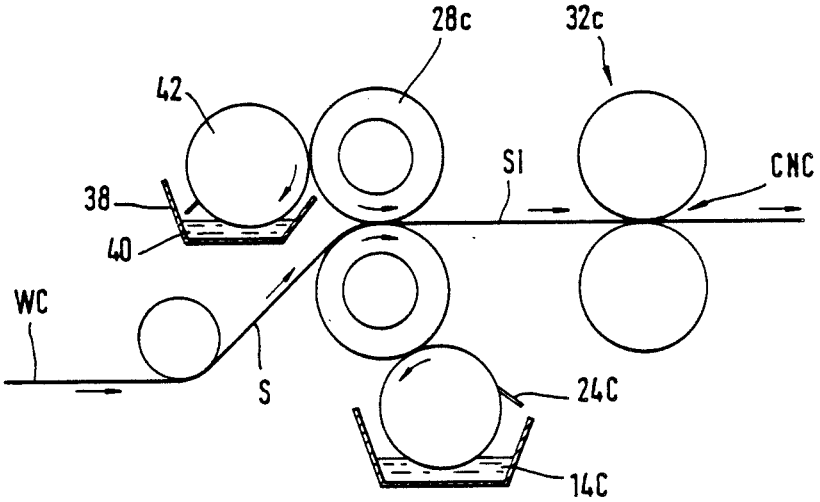

METHOD OF MANUFACTURING A COMPRESSIBILITY GRADIENT IN PAPER

BACKGROUND OF THE INVENTION

1. Field of the Invention

The present invention relates to a method of manufacturing a Z-directional compressibility gradient in a web of paper. More particularly, the present invention relates to a method which includes the application of a plasticizer to a web of paper for controlling the Z-directional compressibility gradient in the web.

2. Information Disclosure Statement

In the paper industry, calendering a web of paper is the process by which the surface of the dried web is smoothed in order to provide a surface that is suitable for subsequent printing, writing or coating.

Basically, the calendering step involves passing the dried web through at least one pair of counter-rotating rolls defining therebetween a calendering nip.

In view of the relatively high pressure exerted on the dried web passing through the calendering nip, the web is compressed and the fibers therein are compressed such that the resultant calendered web has a greater density than the web prior to calendering.

In an ideal situation, only the fibers in the vicinity of the surface of the web are compressed and made more dense while the fibers within the web towards the center of the thickness of the web remain relatively uncompressed. The aforementioned calendered web is desirable because it presents a smooth, dense printing surface while maintaining the necessary bulk and stiffness qualities.

In the prior art, water, and other cellulose plasticizers and various plasticizer solutions have been used to aid in the calendering process. Such processes have had limited success in developing a strong Z-directional moisture gradient in the sheet, and have also suffered from uniformity problems.

For example, in the bleached paper board industry, liquid is applied to uncoated paper board via the calender roll. A shallow trough of liquid is pressed against a calender roll to supply the moisture, the trough being known as a water box. The aforementioned method applies an excess of water to the paper board which often results in a flooded calendered nip in which the paper board absorbs as much liquid as it is capable of storing in its void structure. Such a system results in low paper roughness at the expense of stiffness loss and increased paper grammage to reach a given stiffness level Another method that has been proposed is the use of steam boxes. Such steam boxes supply both heat and moisture to the sheet. However, because the steam is a low viscosity fluid, such steam deeply penetrates the paper structure and softens the inner fibers. The aforementioned calender steam treatment generally results in lower roughness, and correspondingly higher density at a given calendering condition.

Another prior art proposal is the use of sprayed moisturizers which offer many advantages but suffer from non-uniform water application due to the liquid droplet size and the difficulty in applying liquid into the depressions of the paper surface. Also, it is difficult to control the air flow near a spray system. Therefore, the object of the present invention is to provide a method of applying a uniform coating of liquid to a rough paper surface during or prior to the calendering process. The method involves the application of plasticizer such that the applied coating of plasticizer penetrates fibers near the paper surface such that these fibers can be easily compressed to impart smoothness to the paper while most of the interior of the paper sheet remains dry and relatively incompressible.

Another object of the present invention is the application of a plasticizer to a web which permits a uniform and controllable penetration of the plasticizer into the web such that the Z-directional compressibility of the web is controlled prior to the web extending through the calender nip.

Other objects and advantages of the present invention will be readily apparent to those skilled in the art by a consideration of the detailed description contained hereinafter taken in conjunction with the annexed drawings.

SUMMARY OF THE INVENTION

The present invention relates to a method of manufacturing a Z-directional compressibility gradient in a web of paper. The method includes the steps of coating the peripheral surface of a roll with a film of plasticizer. An offset roll disposed adjacent to the roll is rotated such that the roll and the offset roll define therebetween a transfer nip so that the film of plasticizer is transferred to the offset roll. The web is moved past the offset roll such that the web contacts the offset roll downstream relative to the transfer nip so that the film of the plasticizer is offset onto the web. The web is passed with the offset coating of plasticizer through a calendering nip such that between the offset coating of the web and the subsequent calendering of the web with offset coating, the plasticizer is permitted to uniformly and controllably penetrate into the web such that the Z-directional compressibility of the web is controlled prior to the web extending through the calender nip.

In a more specific process, the step of rotating the roll further includes the steps of partially immersing the roll within a receptacle and doctoring the film of plasticizer upstream relative to the transfer nip such that a uniform film of the plasticizer remains on the peripheral surface of the roll between the doctor and the transfer nip.

In a preferred method according to the present invention, the plasticizer is water.

The step of rotating an offset roll also includes rotating the offset roll in a direction opposite to the direction of rotation of the roll.

The step of moving the web also includes the step of rotating a further roll disposed adjacent to the offset roll such that the web is disposed between the offset roll and the further roll, the offset roll and the further roll defining therebetween a guide nip for guiding the web towards the calendering nip.

The further roll is a calender roll such that the web is guided between the offset roll and the calender roll and the web is subsequently supported and guided by the calender roll until the web passes through the calendering nip.

The step of moving the web past the offset roll also includes the step of rotating the offset roll in an opposite direction to the direction of rotation of the calender roll such that the guide nip becomes filled with a coating meniscus upstream relative to the guide nip.

In another method, according to the present invention, the further roll is a further offset roll. The further step of rotating the further roll also includes the sub-step of rotating a plasticizer roll disposed adjacent to the further roll and rotating within a further receptacle filled with plasticizer such that the plasticizer is transferred from the plasticizer roll to the further offset roll so that plasticizer is applied t opposite surfaces of the web.

The step of passing the web with the offset coating includes the further step of permitting the plasticizer to coat the surface of the web, which is rough, so that fibers within the web close to the surface of the web being coated are plasticized such that during the passage through the calendering nip, such plasticized fibers are easily compressed to impart smoothness to the web while most of the fibers further away from the surface are not plasticized and consequently remain relatively dry and incompressible.

In another embodiment of the present invention, the roll may also be coated with a fountain or spray of coating and then doctored.

In a preferred embodiment of the present invention, an engraved gravure roll is used to coat an offset roll.

The present invention is not limited to the specific method steps described hereinafter in the detailed description or in the annexed drawings.

Many modifications and variations will be apparent to those skilled in the art by a consideration of the preferred process disclosed in the detailed description. Such variations and modifications, however, fall within the spirit and scope of the present invention as defined in the appended claims.

BRIEF DESCRIPTION OF THE DRAWINGS

FIG. 3 is a side-elevational view of another embodiment of the present invention including reverse roll coating; and FIG. 4 is a side-elevational view of another embodiment of the present invention permitting coating of both sides of the paper web.

Similar reference characters refer to similar parts throughout the various embodiments of the present invention.

DETAILED DESCRIPTION OF THE DRAWINGS

Figure 1:
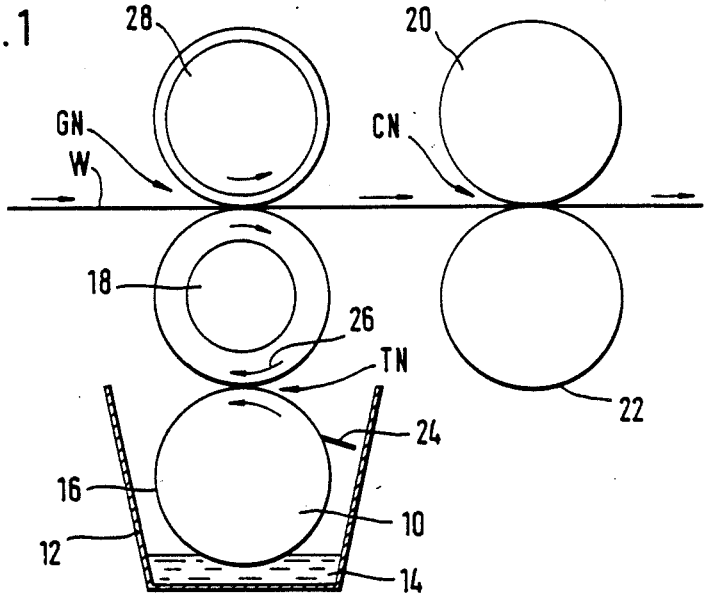
FIG. 1 is a side-elevational view showing an apparatus for carrying out the method according to the present invention.

FIG. 1 is a side-elevational view of a free-standing coater unit disposed upstream relative to a calender nip for carrying out the method according to the present invention.

According to the present invention, a method of manufacturing a Z-directional compressibility gradient in a web of paper W includes the steps of rotating a roll 10 within a receptacle 12 containing a plasticizer 14 such that the peripheral surface 16 of the roll 10 is coated with a film of the plasticizer 14. The roll 10 is preferably an engraved roll such as used in an offset gravure coater or in flexographic printing.

An offset roll 18 is rotated such that the roll 10 and the offset roll 18 define therebetween a transfer nip TN so that the film of the plasticizer 14 is transferred to the offset roll 18.

The web W is moved past the offset roll 18 such that the web W contacts the offset roll 18 downstream relative to the transfer nip TN so that the film of the plasticizer 14 is offset onto the web W.

The web W with the offset coating of plasticizer 14 is passed through a calendering nip CN defined between calender rolls 20 and 22 such that between the offset coating of the web W and the subsequent calendering of the web W with offset coating, the plasticizer is permitted to uniformly and controllably penetrate into the web W such that the Z-directional compressibility of the web W is controlled prior to the web extending through the calendering nip CN.

More specifically, as shown in FIG. 1, the step of rotating the roll 10 within the receptacle 12 also includes the steps of partially immersing the roll 10 within the receptacle 12 and doctoring the film of plasticizer 14 by means of a doctor blade 24 upstream relative to the transfer nip TN such that a uniform film of plasticizer 14 remains on the peripheral surface 16 of the roll 10 between the doctor 24 and the transfer nip TN.

Preferably, the plasticizer is water.

As shown in FIG. 1, the roll 10 and the offset roll 18 are counter-rotated such that the offset roll 18 rotates in a direction as indicated by the arrow 26 in a direction opposite to the direction of rotation of the roll 10.

The step of moving the web W also includes the step of rotating a further roll 28 disposed adjacent to the offset roll 18 such that the web W is disposed between the offset roll 18 and the further roll 28 with the offset roll 18 and the further roll 28 defining therebetween a guide nip GN for guiding the web W towards the calendering nip CN.

Figure 2:
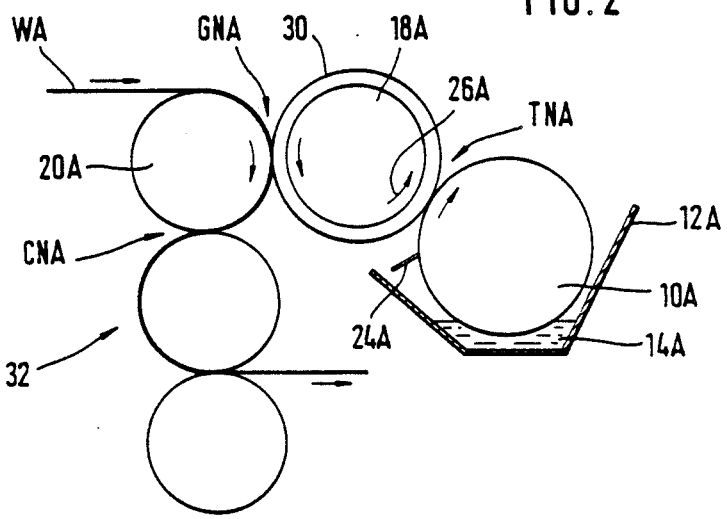
FIG. 2 is a side-elevational view of a further embodiment of the present invention.

FIG. 2 is a side-elevational view of further embodiment of the present invention for carrying out an alternative method according to the present invention.

The apparatus according to FIG. 2 includes a roll 10A which may be an anilox or gravure roll 10A which is rotatably disposed within a receptacle or coating pan 12A. A doctor blade 24A is disposed upstream relative to a transfer nip TNA defined between the roll 10A and an offset roll 18A. The offset roll 18A includes a soft outer cover 30. The offset roll 18A is disposed adjacent to a further roll which is a first calender roll 20A of a calender stack generally designated 32. The arrangement is such that the web WA is guided by the calender roll 20A so that the web WA is disposed between the offset roll 18A and the calender roll 20A. The offset roll 18A and the roll 20A define therebetween a guide nip GNA for guiding the web WA towards a calendering nip CNA.

As shown in FIG. 2, the further roll 20A is a calender roll such that the web is guided between the offset roll 18A and the calender roll 20A and the web is subsequently supported and guided by the calender roll 20A until the web WA passe through the calendering nip CNA.

FIG. 3 is a side-elevational view of another embodiment of the present invention which is similar to the embodiment shown in FIG. 2. However, a roll 10B and an offset roll 18B are rotated in the opposite direction to the direction of rotation shown in FIG. 2 s that the offset roll 18B is rotated in an opposite direction, as indicated by the arrow 26B, to the direction of rotation, as indicated by the arrow 34, of the calender roll 20B such that the guide nip GNB becomes filled with a coating meniscus 36 upstream relative to the guide nip GNB.

FIG. 4 is a side-elevational view of yet another embodiment of the present invention which permits coating of both sides of a web WC prior to calendering. According to FIG. 4, the step of passing a web WC with an offset coating includes the further step of permitting plasticizer 14C to coat a surface S of the web. The further step of rotating a further roll includes the sub-step of rotating a plasticizer roll 36 within a further receptacle 38, the roll 36 being disposed adjacent to a further roll 28C. The receptacle 38 is filled with plasticizer 40 such that the plasticizer 40 is transferred from the plasticizer roll 36 to the further offset roll 28C so that plasticizer is applied to opposite surfaces S and S1 of the web WC.

The step of passing the web WC with the offset coating includes the further step of permitting the plasticizer to coat the surface of the web, which is rough, so that fibers within the web close to the surfaces S,S1 of the web WC being coated are plasticized such that during the passage through the calendering nip CNC, such plasticized fibers are easily compressed to impart smoothness to the web WC while most of the fibers further away from the surfaces S,S1 are not plasticized and consequently remain relatively dry and incompressible.

The present invention provides a simple method of applying a plasticizer to a dried web of paper such that the web is plasticized uniformly and controllably in the vicinity of at least one surface thereof so that the web is permitted to be calendered and smoothed to provide a smooth surface and a relatively uncompressed inner layer.

What is claimed is:

1. A method of manufacturing a Z-directional compressibility gradient in a web of paper, said method comprising the steps of:

coating the peripheral surface of a roll with a film of plasticizer;

rotating an offset roll disposed adjacent to the roll such that the roll and the offset roll define therebetween a transfer nip so that the film of the plasticizer is transferred to the offset roll;

moving the web past the offset roll such that the web contacts the offset roll downstream relative to the transfer nip so that the film of the plasticizer is offset onto the web; and passing the web with the offset coating of plasticizer through a calender nip such that between the offset coating of the web and the subsequent calendering of the web with the offset coating, the plasticizer is permitted to uniformly and controllably penetrate into the web such that the Z-directional compressibility of the web is controlled prior to the web extending through the calendering nip.

2. A method as set forth in claim 1 wherein the step of rotating the roll within the receptacle further includes the steps of:

partially immersing the roll within a receptacle containing the plasticizer; doctoring the film of plasticizer upstream relative to the transfer nip such that a uniform film of the plasticizer remains on the peripheral surface of the roll between the doctor and the transfer nip.

3. A method as set forth in claim 1 wherein the step of rotating the roll includes rotating the roll within the plasticizer, which is water.

4. A method as set forth in claim 1 wherein the step of rotating an offset roll further includes:

rotating the offset roll in a direction opposite to the direction of rotation of the roll.

5. A method as set forth in claim 1 wherein the step of moving the web further includes the step of:

rotating a further roll disposed adjacent to the offset roll such that the web is disposed between the offset roll and the further roll, the offset roll and the further roll defining therebetween a guide nip for guiding the web towards the calendering nip.

6. A method as set forth in claim 5 wherein the further roll is a calender roll such that the web is guided between the offset roll and the calender roll, the web being subsequently supported and guided by the calender roll until the web passe through the calendering nip.

7. A method as set forth in claim 6 wherein the step of moving the web past the offset roll further includes the step of:

rotating the offset roll in an opposite direction to the direction of rotation of the calender roll such that the guide nip becomes filled with a coating meniscus upstream relative to the guide nip.

8. A method as set forth in claim 5 wherein the further roll is a further offset roll, the further step of rotating the further roll including the sub-step of:

rotating a plasticizer roll disposed adjacent to the further roll and rotating within a further receptacle filled with plasticizer such that the plasticizer is transferred from the plasticizer roll to the further offset roll so that plasticizer is applied to opposite surfaces of the web.

9. A method as set forth in claim 1 wherein the step of passing the web with the offset coating includes the further step of:

permitting the plasticizer to coat the surface of the web, which is rough, so that fibers within the web close to the surface of the web being coated are plasticized such that during the passage through the calendering nip, such plasticized fibers are easily compressed to impart smoothness to the web while most of the fibers further away from the surface are not plasticized and consequently remain relatively dry and uncompressible.

10. A method of manufacturing a Z-directional compressibility gradient in a web of paper, said method comprising the steps of:

coating a roll with a plasticizer from a fountain;

doctoring the coated roll;

transferring the doctored coating of plasticizer to an offset roll;

moving the web past the offset roll such that the web contacts the offset roll downstream relative to the transfer nip so that the film of the plasticizer is offset onto the web; and passing the web with the offset coating of plasticizer through a calender nip such that between the offset coating of the web and the subsequent calendering of the web with the offset coating, the plasticizer is permitted to uniformly and controllably penetrate into the web such that the Z-directional compressibility of the web is controlled prior to the web extending through the calendering nip.

11. A method of manufacturing a Z-directional compressibility gradient in a web of paper, said method comprising the steps of coating the peripheral surface of a roll with a film of plasticizer;

the coating step further including:

spraying the peripheral surface with a fountain of the plasticizer;

rotating an offset roll disposed adjacent to the roll such that the roll and the offset roll define therebetween a transfer nip so that the film of the plasticizer is transferred to the offset roll moving the web past the offset roll such that the web contacts the offset roll downstream relative to the transfer nip so that the film of the plasticizer is offset onto the web; and passing the web with the offset coating of plasticizer through a calender nip such that between the offset coating of the web and the subsequent calendering of the web with the offset coating, the plasticizer is permitted to uniformly and controllably penetrate into the web such that the Z-directional of compressibility of the web is controlled prior to the web extending through the calendering nip.

12. A method of manufacturing a Z-directional compressibility gradient in a web of paper, said method comprising the steps of:

coating the peripheral surface of a roll with a film of plasticizer;

the coating step further including:

coating the peripheral surface by means of a short dwell coater and then doctoring the applied coating;

rotating an offset roll disposed adjacent to the roll such that the roll and the offset roll define therebetween a transfer nip so that the roll of the plasticizer is transferred to the offset roll;

moving the web past the offset roll such that the web contacts the offset roll downstream relative to the transfer nip so that film of the plasticizer is offset onto the web; and passing the web with the offset coating of plasticizer through a calender nip such that between the offset coating of the web and the subsequent calendering of the web with the offset coating, the plasticizer is permitted to uniformly and controllably penetrate into the web such that the Z-directional compressibility of the web is controlled prior to the web extending through the calendering nip.

* * * * *

UNITED STATES PATENT AND TRADEMARK OFFICE

CERTIFICATE OF CORRECTION

PATENT NO. : 4,973,441

DATED : November 27, 1990

INVENTOR(S) : Samuel F. Keller

It is certified that error appears in the above—identified patent and that said Letters Patent is hereby corrected as shown below:

Column 6, Line 12: Please delete "passe" and insert therefor --passes--.

Signed and Sealed this

Fifth Day of May, 1992

*Attest:*

DOUGLAS B. COMER

*Attesting Officer*

*Acting Commissioner of Patents and Trademarks*